US009282388B2

(12) United States Patent
Wegener

(10) Patent No.: US 9,282,388 B2
(45) Date of Patent: Mar. 8, 2016

(54) SOUND SYSTEM USING REPURPOSED MATERIALS

(71) Applicant: Adam Stephen Wegener, Sunnyvale, CA (US)

(72) Inventor: Adam Stephen Wegener, Sunnyvale, CA (US)

(73) Assignee: Adam Stephen Wegener, Sunnyvale, CA (US)

( * ) Notice: Subject to any disclaimer, the term of this patent is extended or adjusted under 35 U.S.C. 154(b) by 357 days.

(21) Appl. No.: 13/870,967

(22) Filed: Apr. 25, 2013

(65) Prior Publication Data

US 2014/0321686 A1 Oct. 30, 2014

Related U.S. Application Data

(60) Provisional application No. 61/638,683, filed on Apr. 26, 2012.

(51) Int. Cl.
*H04R 1/02* (2006.01)
*H04R 9/06* (2006.01)

(52) U.S. Cl.
CPC ..... *H04R 1/028* (2013.01); *H04R 1/025* (2013.01)

(58) Field of Classification Search
CPC ..... G09F 23/0091; H04R 1/02; H04R 1/025; H04R 1/0228; H04R 1/028
USPC ..... 381/124, 386, 387, 352, 334, 332, 338, 381/339, 395, 345
See application file for complete search history.

(56) References Cited

U.S. PATENT DOCUMENTS

| | | | | |
|---|---|---|---|---|
| 5,664,745 | A | 9/1997 | Hadaway | |
| 6,771,165 | B2 | 8/2004 | Burg, II | |
| D498,228 | S | 11/2004 | Kasden | |
| 7,134,932 | B1 * | 11/2006 | Carrasco et al. | 446/227 |
| D570,826 | S | 6/2008 | Fong | |
| 2008/0112580 | A1 | 5/2008 | Files | |
| 2012/0076337 | A1 * | 3/2012 | Wegener | 381/334 |

FOREIGN PATENT DOCUMENTS

CN 2557440 Y 6/2003

OTHER PUBLICATIONS

Product Title: Killer Concepts Beer Can Rechargeable Speaker, Source: www.amazon.com, Date First available on Amazon: Oct. 15, 2013, URL visited Oct. 1, 2014: http://www.amazon.com/Killer-Concepts-Beer-Rechargeable-Speaker/dp/B00FW7082G.

Author: Ben Wisoff, Title: Wine Bottle Speakers, Source: www.speakersinglass.com, Product Title: Wine Bottle Speakers, Date Published: unknown, URL visited Oct. 1, 2014: http://www.speakersinglass.com/p/wine-bottle-speakers.html.

(Continued)

*Primary Examiner* — Vivian Chin
*Assistant Examiner* — Douglas Suthers

(57) ABSTRACT

The present invention is a sound system made from a repurposed vessel. The repurposed vessel is separated into two or more pieces for installation of a speaker assembly and then the pieces are put back in their original form. A hole is created in the vessel wall through which sound waves may pass. The speaker assembly has a connector allowing connection to an audio source. The space between the top and bottom pieces and the speaker assembly may be adjusted to tune for a desired frequency response.

6 Claims, 16 Drawing Sheets

(56) References Cited

OTHER PUBLICATIONS

Author: Geek Alerts, Title: USB Wine Bottle Speaker with Radio, Source: www.geekalerts.com, Product Title: USB Wine Bottle Speaker with Radio, Date Published: Sep. 8, 2010, URL visited Oct. 1, 2014: http://www.geekalerts.com/usb-wine-bottle-speaker-radio/.

Author: Jennifer MomSpotted, Title: The Sharper Image Wireless Indoor & Outdoor Speaker Pair and Dock Review & Giveaway!, Source: www.momspotted.com, Product Title: Sharper Image Wireless Indoor & Outdoor Speaker Pair, Date Published: May 9, 2011, URL visited Oct. 1, 2014: http://momspotted.com/2011/05/the-sharper-image-wireless-indoor-outdoor-speaker-pair-and-dock-review-giveaway.html.

Product Title: Transglass Wine Bottle Vase, Source: www.artecnicainc.com, URL visited Oct. 1, 2014: http://www.artecnicainc.com/Products/Design__with__Conscience/tranSglass%C2%AE.

Author: Ken Xu, Title: Sexy Sound Box Dock Station Looks Like a Wine Bottle, Source: www.hardwaresphere.com, Product Title: Sound Box Dock Station, Date Published: Jul. 20, 2011, URL visited Oct. 1, 2014: http://www.hardwaresphere.com/2011/07/20/sexy-sound-box-dock-station-looks-like-a-wine-bottle/.

Author: DesignBoom, Title: Sante Kim at DesignersBlock, Source: www.designboom.com, Product Title: Wine Bottle Speaker, Date Published: Sep. 28, 2008, URL visited Oct. 1, 2014: http://www.designboom.com/design/london-design-festival-08-sante-kim-at-designersblock/.

Author: NAC Sound, Source: www.nacsound.com/en, Product Title: Linea Classic Speaker, Date Published: 2011, URL visited Apr. 22, 2013: http://www.nacsound.com/en/download.html.

* cited by examiner

SOUND SYSTEM USING REPURPOSED MATERIALS

CROSS-REFERENCE TO OTHER APPLICATIONS

Claim is made of the benefit of U.S. Provisional Application No. 61/638,683 filed on Apr. 26, 2012.

BACKGROUND

This invention relates to the field of audio sound systems for use with audio devices such as MP3 players, computers, home stereo systems, and more. With the growing popularity of portable audio players has come a need for well-designed audio accessories. To share music from these devices with others, users often purchase a sound system for high quality sound that everybody can hear.

Consumers wish to minimize negative environmental impacts products have on the world. This is reflected in the trend known as "going green." Consumers care about the planet and demonstrate this concern in the products they purchase. Most sound systems currently on the market utilize virgin materials to manufacture speaker system housing and do not take advantage of this new trend in sustainability. Reusing or repurposing old materials rather than throwing them away reduces environmental impact and waste.

Recently, companies have started exploring products which utilize repurposed or recycled materials. Repurposed materials are used for a purpose different than its original intended purpose. While most products involving repurposed materials do not have an electronic component, sound systems which utilize repurposed materials are starting to enter the market. However, the majority of these products are handmade, one of a kind pieces. The manufacture of these products cannot be scaled to satisfy the world consumer market. Therefore, manufacturers seek design innovations that make these sustainable products more manufacturable with "mass production" potential.

Products currently on the market that relate to the present invention fall into three categories:

a. Non-audio products that utilize repurposed materials
b. Sound systems constructed with virgin materials
c. Sound systems with directional output FIG. 1 shows how beverage bottles can be cut to create drinkware and household decoration. Often wine bottles are cut at the top of the cylindrical body to make cups for beverages or vases to hold flowers. In this case, the wine bottle is considered a "repurposed material". In this case, the original intended purpose of the wine bottle was to store wine, but now the wine bottle serves as a flower vase, and is therefore "repurposed".

Products which utilize repurposed wine bottles provide novelty for wine lovers. Creating beverage cups and decorative pieces by reusing beverage bottles uses significantly less energy than creating new products from virgin materials, which reduces impact on the earth.

FIG. 2 shows a wireless speaker system used for playing audio. A speaker facing downward generates sound waves which deflect off of a horn and travel outward radially from the unit through a space between the top and bottom portion of the unit. This allows for users to hear music regardless of their location around the speaker.

Traditional speaker units utilize a horizontal speaker orientation, a speaker whose central axis is parallel to the ground, resulting in sound waves traveling in one direction coming from the speaker cone. Users located in line with the sound waves have an optimal listening experience, but users to the side of or behind the speaker will experience loss of high frequency and general loss of volume. For this reason, the speaker unit in FIG. 2 is preferred for group listening situations. The speaker unit is placed in the center of the room or gathering, clearly broadcasting audio in all directions for guests throughout the room. This product does not utilize repurposed materials.

FIG. 3 shows a beer bottle-like musical speaker from Design Patent D510083. The unit consists of a beer bottle with a hole cut in the side through which audio waves pass. This unit would presumably be connected to an amplifier and audio source. It is assumed that the speaker is oriented horizontally, with the central axis parallel to the ground. As discussed in the explanation of FIG. 2, this horizontal speaker orientation sends sound waves out in one direction. Users not located directly in line with the speaker will experience decreased frequency range and volume.

Additionally, this design patent does not discuss manufacturing methods. Cutting a hole for mounting a speaker on the side of a cylindrical body as shown in the figure may prove to be an extremely difficult manufacturing operation because of the cylindrical surface. Complex manufacturing techniques often result in high manufacturing costs. Additionally, typical speakers have a planar mounting surface, however the beer bottle is cylindrical. The design patent does not discuss how the speaker can be mounted to the cylindrical beer bottle body.

FIG. 4 shows a portable speaker unit that resembles a wine bottle. The unit has a control panel for audio control and a speaker facing out of the bottom of the unit. The speaker cannot broadcast audio in the normal orientation of a wine bottle, as the speaker would direct sound waves into the table. Therefore, this product includes a stand to hold the unit in a sideways orientation. Sound waves travel outward from the speaker in one direction. Listeners not in line with the speaker axis will experience decreased frequency range and volume. The unit looks like a wine bottle in shape, but does not actually utilize repurposed materials.

FIG. 5 shows a portable speaker unit which resembles a beer can. The speaker unit utilizes a speaker facing upward, directing sound waves out the "mouth." This small opening limits high frequencies and overall volume of the product. Also, when standing it the normal orientation, sound coming from this device travels upward, instead of towards users around the can. The unit looks like a beer can in shape, but does not actually utilize repurposed materials.

As seen in FIG. 4 and FIG. 5, sound systems currently on the market produce audio waves which come out of the top or the bottom of the product. However, there are disadvantages associated with these solutions. If the speaker is mounted on the bottom facing outward as shown in FIG. 4, the speaker system cannot stand in the normal orientation because the sound would be directed into the table. If the audio travels upward out of the mouth of the product as shown in FIG. 5, sound volume and frequency range is greatly restricted by the narrow opening. Additionally, the sound is directed up into the air instead of to listeners around the device. The device could be placed on its side to overcome the problems above, however the user must still be positioned in line with the speaker cone for the optimal listening experience.

SUMMARY OF THE INVENTION

A sound system utilizing repurposed materials with at least one opening through which sound waves may pass to listeners around the device. The present invention moves past traditional assumptions that with a repurposed sound system, sound must come out of the top or the bottom of the repurposed item. Instead, openings around the body of the unit create a multi-directional sound experience. The size and shape of these openings may be adjusted to tune for desired frequency response, and may also be designed to suit the aesthetic desires of the consumer. This sound system is preferred for group listening situations because it can be placed in the middle of a space to broadcast sound in multiple directions to listeners in the area. This sound system can be used for playing audio from devices such as MP3 players, phones, laptops, DVD players, and instruments. Audio signal may be transmitted via cord with plug or via wireless protocol such as Bluetooth.

The present invention utilizes repurposed food and liquid containers to save energy compared to manufacturing processes using virgin materials. Most users have never seen music coming from food and beverage containers, such as a wine bottle, so there's a novelty factor to the present invention. The present invention allows the speaker to blend in to the room décor and be hidden, unlike typical black speaker boxes which stand out. The repurposed container has been cut into two or more pieces for insertion of speaker, amplifier, power source, etc. and then the pieces may be put back in their original form for maximum novelty factor. The repurposed container can stand in the original orientation for maximum novelty and surprise factor.

Additionally, dimensional variability in food and beverage materials, especially glass containers, presents a manufacturing challenge. Variable body diameters and poor body cylindricity would seem to eliminate a one size fits all sound system, requiring a custom seal for each vessel. However, the present invention overcomes this challenge by making use of the feature with little dimensional variation from vessel to vessel: the inner diameter of the neck.

One embodiment of the current invention takes advantage of the similarity in neck diameter by mounting all electronics in a universal support structure which is fixed inside of the neck portion of the vessel. This solution is compatible with a variety of repurposed materials so long as the neck is generally the same diameter. It is advantageous to mass produce a one size fits all solution to reduce unit cost and to simplify the manufacturing and assembly process.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as series forth hereinafter.

DETAILED DESCRIPTION

Figure 1:
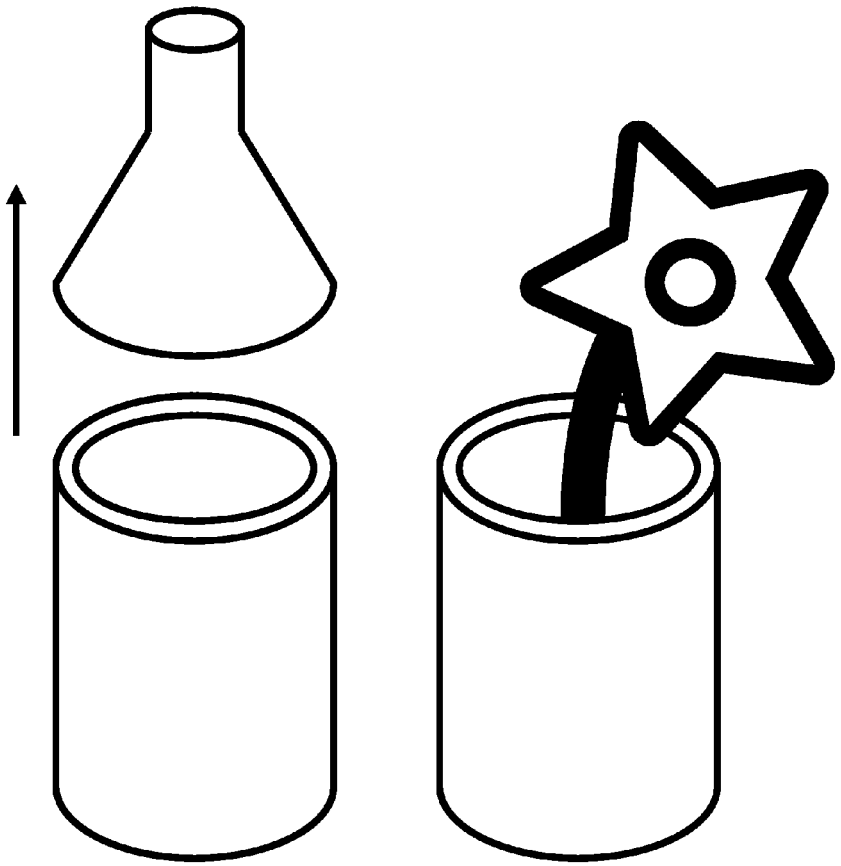
Figure 1 (prior art)
FIG. 1 shows a flower vase created from an empty wine bottle.
Figure 2:
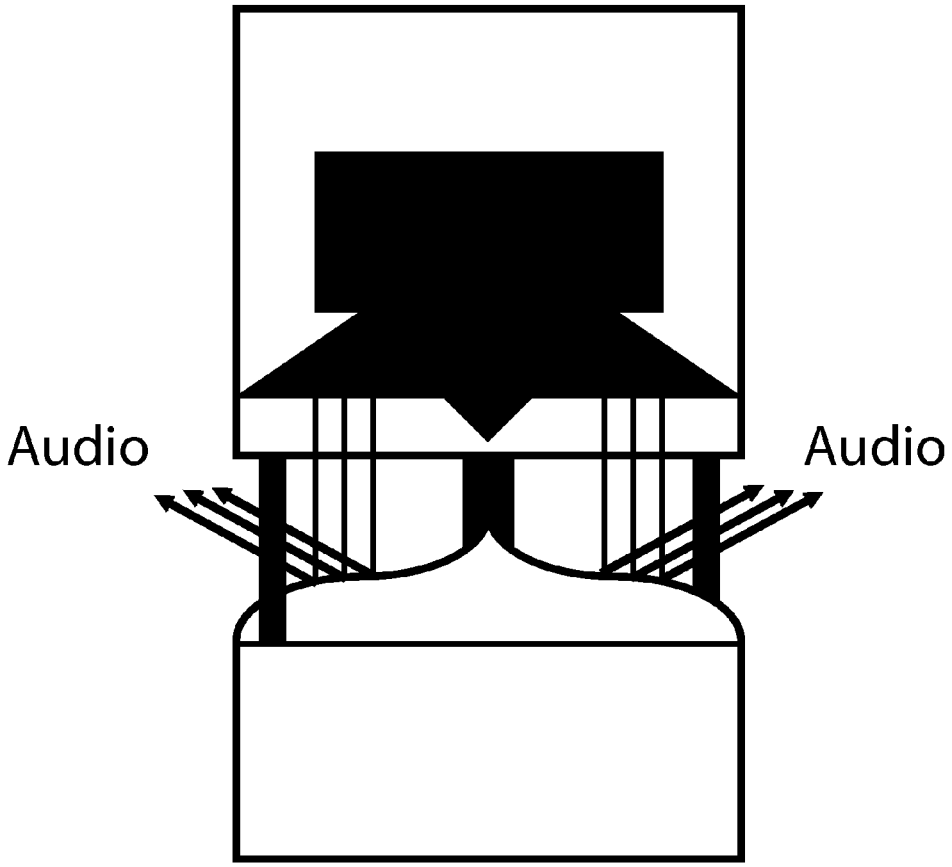
Figure 2 (prior art)
FIG. 2 shows a wireless speaker unit with downward facing speaker and horn deflector.
Figure 3:
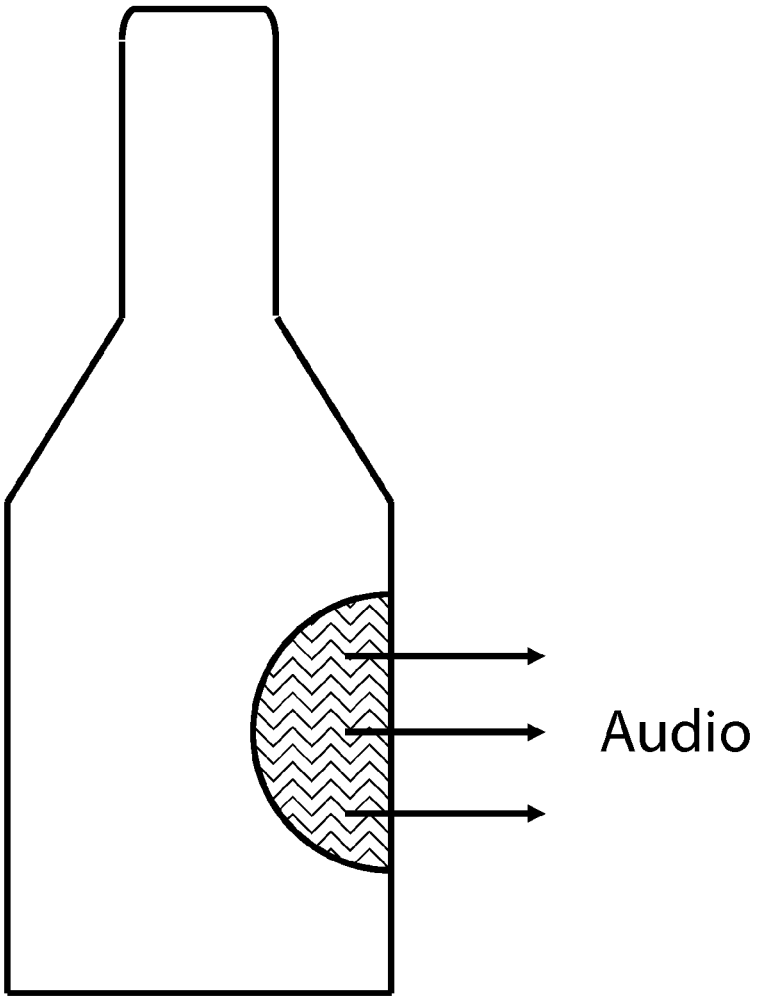
Figure 3 (prior art)
FIG. 3 shows a beer bottle-like musical speaker, design patent D510083.
Figure 4:
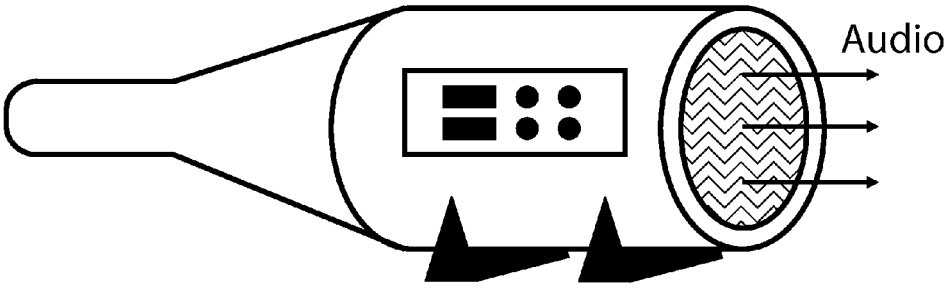
Figure 4 (prior art)
FIG. 4 shows a portable speaker unit that resembles a wine bottle.
Figure 5:
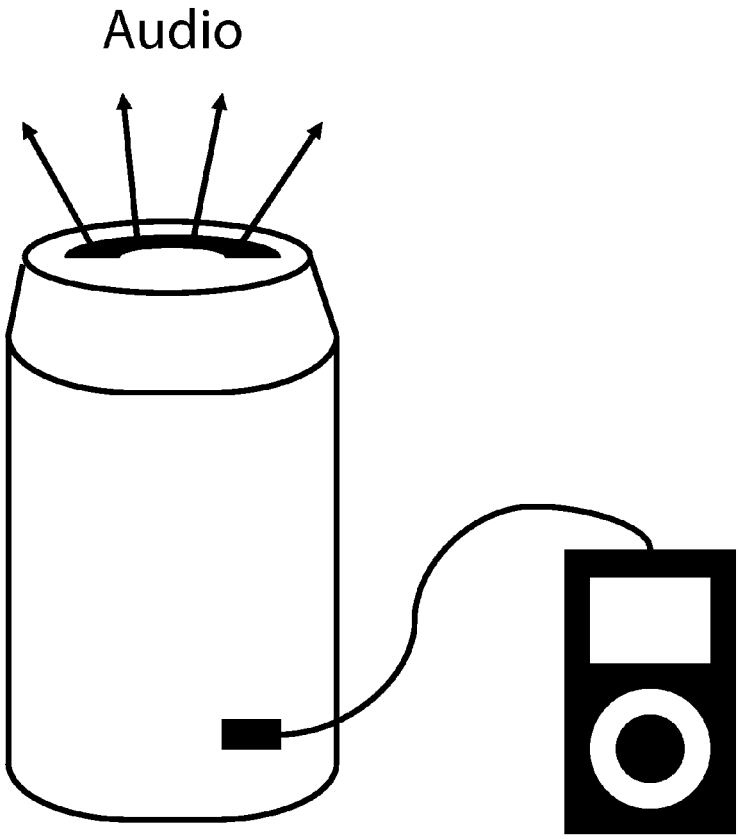
Figure 5 (prior art)
FIG. 5 shows a portable speaker unit which resembles a beer can.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

The present invention is a sound system comprising a repurposed vessel and a speaker assembly. The vessel is cut into two portions and a speaker assembly is installed within one of the portions. The two portions are then reassembled in their original form. At least one opening must be present through which audio can pass out of the repurposed vessel to listeners. The opening may be comprised of a separation between the vessel portions, and/or one or more sections of the vessel portions removed or cut away.

For the purposes of this specification, speaker assembly is a general term used to describe a variety of different configurations of electronics used for sound systems. As previously mentioned, the speaker assembly is contained in one of the vessel portions. In the simplest embodiment, the speaker assembly consists of a speaker driver coupled to a cable through which audio signals may be transmitted to the speaker from an external audio source. In another embodiment, the speaker assembly consists of a speaker driver which is coupled to a PCB with amplifier, power source, and Bluetooth module to receive audio signal wirelessly from an external audio device. In an alternate embodiment, the speaker system may include an integrated audio source such as an AM/FM radio or pre-recorded audio files. In summary, speaker assembly may include a variety of different components, such as but not limited to speaker drivers, power sources, PCBs with amplifiers, wireless receivers (Bluetooth, etc), audio jacks, charging interfaces, audio sources (radio module, etc), LED light indicators, and switches. Also included in the speaker assembly shall be a means by which to connect those items, such as cables, cords, or PCB traces.

Figure 6:
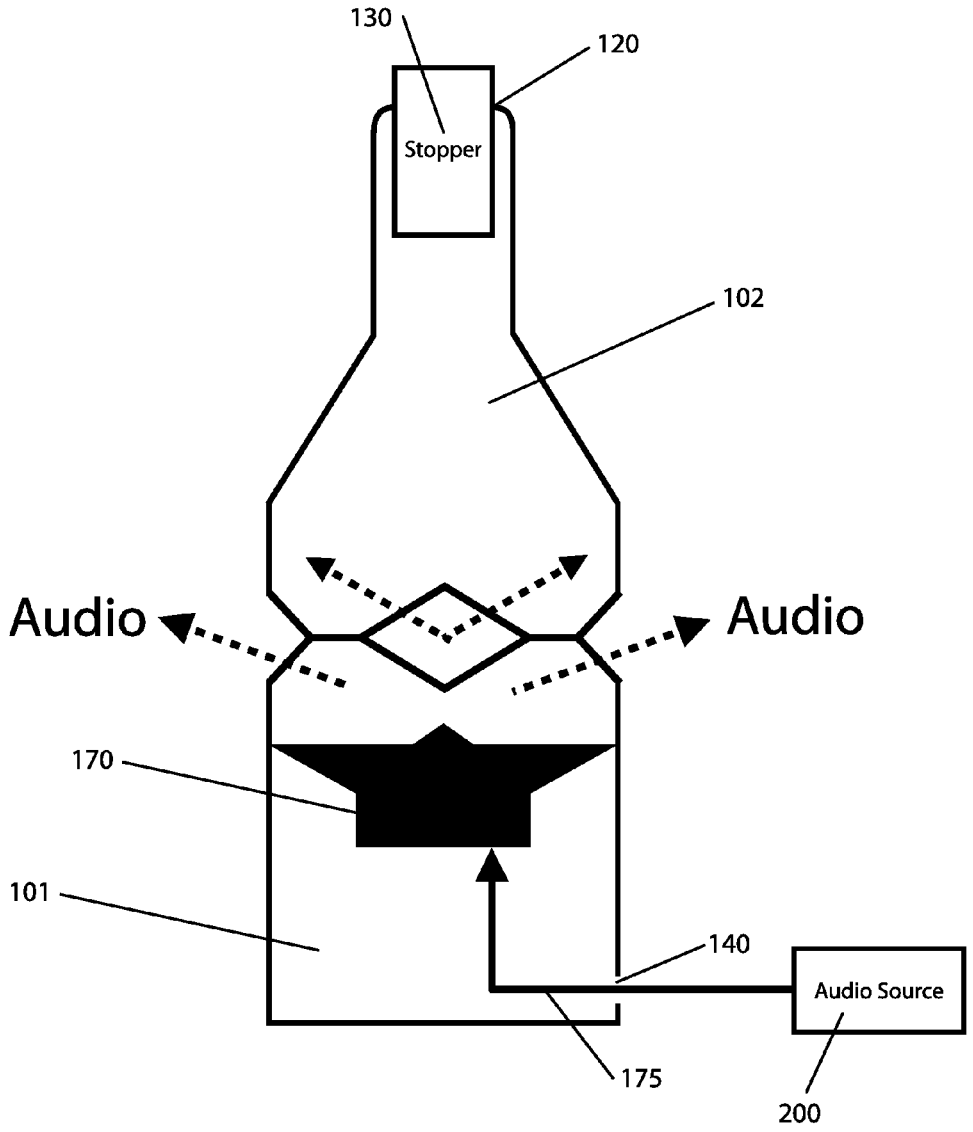
FIG. 6 shows an embodiment of the present invention with upward facing speaker.

FIG. 6 shows an embodiment of the present invention having a repurposed container or vessel with upward facing speaker. The term "vessel" will be used throughout the following figure descriptions to represent "repurposed container". Examples of vessels include the following items: wine bottles, peanut butter jars, mason jars, hairspray cans, spray paint cans, beer bottles, soda cans, orange juice containers, milk cartons, water bottles, aluminum beer bottles, and cleaning product bottles. The vessel may be comprised of ceramic, glass, plastic, wood, metal, fiber, composite, paper or any combination of those materials. The vessel type and material shall not limit the scope of the present invention. In the present embodiment, the vessel is cylindrical in shape, representing vessels such as but not limited to wine bottles and other liquid containers. In other embodiments, the vessel may have a cubical form or other geometry, such as but not limited to a milk carton or orange juice container. However, the shape, size, geometry or type of vessel shall not limit the scope of the present invention.

To install speaker 170 into the repurposed vessel, the vessel has been cut into two pieces: vessel bottom 101 and vessel top 102. The cut is necessary because speaker 170 may be too large to fit through mouth 120. In this embodiment, speaker 170 is coupled to vessel bottom 101 with the speaker facing upward. Speaker 170 is fixed to vessel bottom 101 to provide mechanical stability, as well as to create an acoustic chamber behind speaker 170. Glue, fasteners, tape, friction, rubber seal, or any combination of those items are acceptable solutions for attaching speaker 170 to vessel bottom 101. Speaker 170 can be mounted closer to or further from the bottom of vessel bottom 101 to change the acoustic chamber size, therefore tuning the output of the speaker to the preference of the listener.

The present invention uses audio source 200 to supply audio signal to speaker 170. Audio source 200 may be any device which produces audio signals, such as, but not limited to, computers, iPods, CD players, cell phones, and even other Bluetooth speakers. The audio signal is transmitted from audio source 200 to speaker 170 via speaker cable 175. Speaker cable 175 is an electrical conductor, most commonly consisting of two insulated wires. Speaker cable 175 travels from audio source 200 through sealed hole 140 in vessel bottom 101 to speaker 170. Sealed hole 140 may be a drilled or machined hole in vessel, thereafter a rubber or glue seal may be added. In subsequent embodiments, wireless technology is employed to eliminate hole 140 and the associated manufacturing operations.

After speaker 170 is installed in vessel bottom 101, vessel bottom 101 is reattached to vessel top portion 102 to regain the original appearance of the vessel. They may be attached using glue, fasteners, tape, friction or any combination. In the present embodiment, material is removed from vessel bottom 101 and vessel top 102. This creates openings through which audio may pass out of the repurposed housing after vessel bottom 101 and vessel top 102 are reunited. In this embodiment, material has been removed from both vessel bottom 101 and vessel top 102 by diagonal cuts with a diamond saw blade. However, any manufacturing method which cuts the vessel is acceptable. The size and shape of the cuts can be changed to adjust for desired sound properties. In subsequent embodiments, a spacer may be used as an alternate means of creating an opening for audio to pass. This may be advantageous to eliminate manufacturing operations, such as cuts, to be performed on the vessel.

Stopper 130 seals vessel mouth 120 at the top of vessel top 102. This ensures all sound waves travel out through the diamond shaped holes formed by vessel bottom 101 and vessel top 102. The resulting sound waves from speaker 170 travel out radially to reach listeners surrounding the device. If stopper 130 is not present, sound waves will travel out of vessel top 102 toward the sky, resulting in loss of volume and frequency range experience by users. If user wishes to direct sound upward, stopper 130 can be removed from mouth 120. Stopper 130 may be comprised of cork, wood, plastic, metal, rubber, or glue substance so as to prevent sound waves from exiting vessel top 102.

Figure 7:
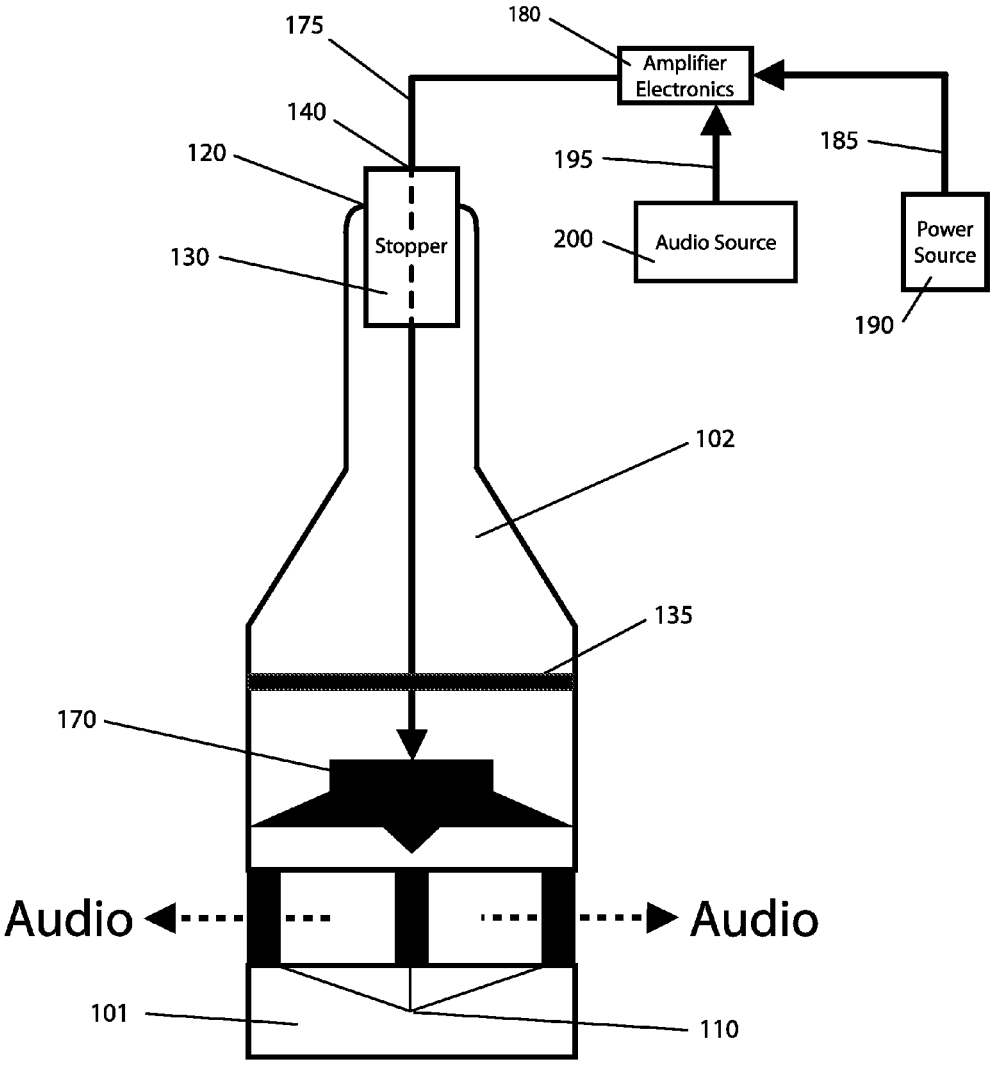
FIG. 7 shows an embodiment of the present invention with downward facing speaker and detailed electronics.

FIG. 7 shows an embodiment of the present invention having a vessel with downward facing speaker, electronic components and spacer. To install speaker 170 inside of the vessel, the vessel has been cut into two pieces: vessel bottom 101 and vessel top 102. In this embodiment, speaker 170 is coupled to vessel top 102 with the speaker facing downward. Glue, fasteners, tape, friction, rubber seal, or any combination of those items are acceptable solutions for attaching speaker 170 to vessel top 102.

This embodiment displays a more intricate electronics setup than simple audio source 200 from FIG. 6. Audio source 200 may not produce enough power for users to hear audio generated by speaker 170. Therefore, this embodiment employs power source 190 and amplifier electronics 180 to amplify signal from audio source 200 for increased performance capabilities. Amplifier electronics most commonly refers to a printed circuit board (PCB) with electrical components connected by traces for the desired functionality. Electrical components commonly found on the PCB include amplifier chips, battery recharging chips, resistors, capacitors, diodes, LEDs, and many more. Amplifier electronics 180 will have headers or thru holes for connection of inputs and outputs, such as power source 190, audio source 200, speaker 170, and others. This embodiment utilizes electronics external to the speaker system body, however other embodiments demonstrate a stand-alone solution with integrated electronics.

Audio source 200 may be any device which produces audio signals, such as, but not limited to, computers, iPods, CD players, radios, cell phones, and even other Bluetooth speakers. The audio signal is transmitted from audio source 200 to amplifier electronics 180 via signal interface 195. Amplifier electronics 180 requires power source 190 to amplify signal from audio source 200. Power source 190 may represent a wall transformer plugged into an electrical outlet, batteries, solar cell, or other power source. Electricity from power source 190 is carried to amplifier electronics 180 via power cable 185. Power cable 185 is electrically conductive, most commonly two insulated wires for carrying ground and power from power source 200 to amplifier electronics 180.

After the signal from audio source 200 is amplified by amplifier electronics 180, it travels through speaker cable 175 through sealed hole 140 in stopper 130 to speaker 170. Stopper 130 seals vessel mouth 120, create a sealed cavity in vessel top 102 behind speaker 170, maximizing audio volume. If user wishes to "port" vessel top to modify bass response, stopper 130 may be removed in part or in whole from mouth 120.

In this embodiment, vessel bottom 101 is coupled to vessel top portion 102 via spacer 110. Spacer 110 may be comprised of cardboard, wood, plastic, metal or other material that provides mechanical stability between vessel bottom 101 and vessel top 102. Glue, fasteners, tape, friction or any combination of those items are acceptable solutions for attaching vessel bottom 101 to spacer 110, and spacer 110 to vessel top portion 102. Besides providing mechanical stability, spacer 110 creates a space between vessel bottom 101 and vessel top 102 through which audio may pass radially from speaker 170 to users all around the device. Spacer 110 eliminates the need for cuts or modifications of the repurposed material like those shown in the previous figure.

This embodiment includes tuning plug 135, which allows the volume of space behind speaker 170 to be adjusted for optimal listening. This component is optional and useful if tuning of sound output is desired. Tuning plug 135 fits in the main body of vessel top 102. Tuning plug 135 seals the space behind speaker 170 and contains a sealed hole through which speaker cable 175 passes. Tuning plug 135 is commonly made of rubber so as to create a seal with the inside surface of vessel top 102, commonly made of glass. Tuning plug 135 can be moved closer or farther from speaker 170 in vessel 102 to create a volume of air behind speaker 170 for a desired frequency range and sound output. When tuning plug 135 is utilized, stopper 130 is not required because tuning plug 135 creates a seal cavity behind speaker 170.

During the manufacturing process, tuning plug 135 can be used to set different preset listening profiles such as boosted high end or enhanced low end performance. Alternatively, the user may have the ability to adjust the position of tuning plug 135 with reference to speaker 170 for optimal listening to their preferred genre of music. Additionally, speaker 170 may be moved up and down in vessel top 102 as a further parameter to adjust sound output. Although tuning plug 135 is not shown in other embodiments in this specification, it may be utilized to adjust audio output in any embodiment. Additionally, it shall be noted that the position of speaker 170 and electronic components can be adjusted in any embodiment so as to optimize sound output by means of increasing or decrease the sealed space behind speaker 170.

It shall be noted that the present invention can be used on a table or other surface, resting on the bottom of vessel bottom 101. Alternately, the sound system can be hung from above, with speaker cable 175 supporting the weight of the sound system. This hanging option may be preferred for home theater setups or museums.

Figure 8:
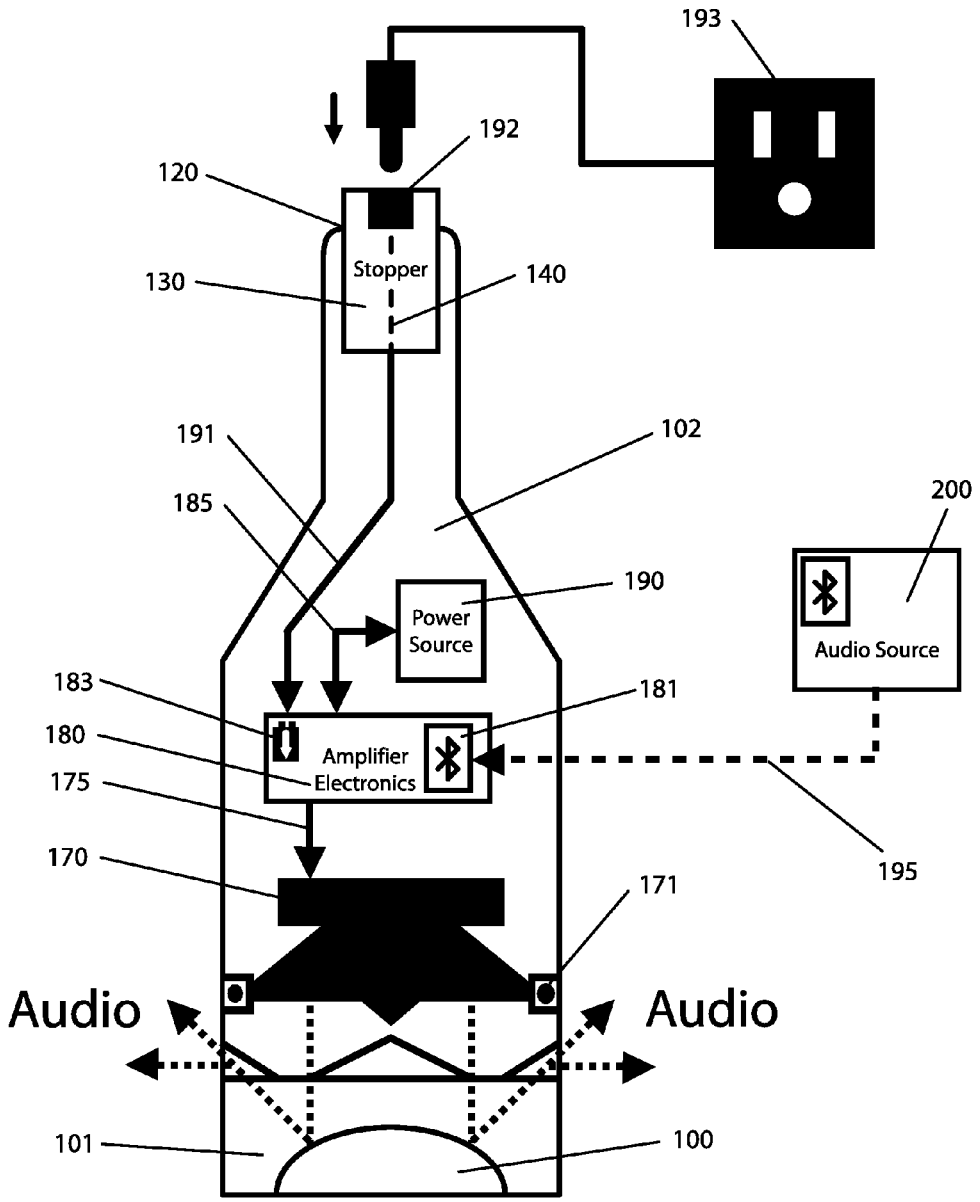
FIG. 8 shows an embodiment of the invention integrated electronics and wireless connectivity.

FIG. 8 shows an embodiment of the invention with integrated electronics. In this embodiment, the vessel is a glass wine bottle with cylindrical body. To install speaker 170 and assorted electronics, vessel is cut into two pieces: vessel bottom 101 and vessel top 102. Vessel top 102 contains speaker 170, amplifier electronics 180, and power source 190 for operation.

In the current embodiment, audio source 200 transmits audio signals via signal interface 195 wirelessly via Bluetooth connection to Bluetooth module 181 on amplifier electronics 180. Alternatively, the signal interface could be radio waves transmitted from a radio emitter to a radio receiver mounted on the printed circuit board, or any other wireless data transfer protocol. Bluetooth module 181 is a printed circuit board with Bluetooth chip and other components required for wireless functionality. Bluetooth module 181 is commonly soldered directly to amplifier electronics 180.

Bluetooth capability is commonly available in cell phones, personal computers, MP3 players, and other music sources. Users prefer wireless connectivity when possible so as not to be limited by the length of an audio cord. Additionally, wireless connectivity preserves the original appearance of the repurposed material because there are no wires required to use it.

Power source 190, a rechargeable battery, provides power to amplifier electronics 180 via power cable 185 for amplification of audio signals. Audio signals are transmitted from amplifier electronics 180 to speaker 170 via speaker cable 175. Downward facing speaker 170 produces sound waves which reflect off of punt 100, the bubble at the base of vessel bottom 101, and out of space between vessel bottom 101 and vessel top 102 radially to users around the product. Similar to the first embodiment, this preferred embodiment utilizes cuts on vessel top 102. These triangular openings allow sound to pass out of the repurposed housing to surrounding listeners. These cuts eliminate the need for spacer 110, and reduce the number of parts required to make the invention. The size and shape of the cuts may be adjusted to tune audio properties. The size, shape and number of sound openings shall not limit the scope of this invention.

Users will wish to recharge their speaker product, and may do so using charging source 193, in this case a wall transformer, taking an AC input and creating a DC charging output. Charging source 193 could alternatively be a battery pack or solar panel. In this preferred embodiment, users do not have access to power source 190. Therefore, charging source 193 can be plugged into power jack 192, which is mounted in stopper 130.

Power jack 192 is commonly purchased "off the shelf", and is made of plastic and/or metal. Electricity passes from charging source 193 through power jack 192 to charging cable 191 inside of vessel top 102 to amplifier electronics 180, which includes battery recharging circuitry for control of recharge of power source 190, rechargeable battery pack. Charging cable 191 passes through sealed hole 140 in stopper 130. Charging cable 191 is most commonly two insulated wires, but any solution which serves to safely conduct electricity is acceptable. Alternatively, charging source 193 may be used to power amplifier electronics 180 directly, so as not to drain power from power source 190. Simultaneous charging and product usage is a desirable feature.

In an alternate embodiment, inductive charging technology (also known as "wireless charging") may be utilized to supply the unit with power and/or recharge power source 190. This configuration would make space for a power switch on the top of stopper 130 because power jack 192 is not required for inductive charging. Inductive charging uses an electromagnetic field to transfer energy between two objects. Inductive charging is becoming more popular among consumers and requires no port or wires for operation.

Power source 190 and amplifier electronics 180 are attached to the top of speaker 170 using glue, fasteners, tape, or other appropriate adhesive. Power source 190 and amplifier electronics 180 may also be attached to the inside surface of vessel top 102 via glue, tape or other adhesive medium for additional mechanical stability, or as an alternative to mounting on top of speaker 170. The outer diameter of speaker 170 may often be smaller than the inner diameter of vessel top 102, so speaker seal 171 may be used to fill the gap. Speaker seal 171 can be made of plastic, epoxy, composite, rubber o-ring, foam, cork, or other material so as to seal the speaker and/or to fix speaker 170 to the inside wall of vessel top 102. Stopper 130 is inside of mouth 120 to seal the space behind speaker 170, and is held in place by friction, glue or other adhesive method. Vessel bottom 101 is adhered to vessel top 102 using glue, tape, wax, or other adhesive method.

The following describes basic operation of the current embodiment. When the user wishes to turn on the speaker unit, the unit shall be inverted to activate tilt switch 183. Tilt switch 183 conducts electricity when held upside down by means of mercury or a ball bearing inside of a barrel connecting two leads of the switch. Tilt switch 183 activates amplifier electronics 180 and Bluetooth module 181. After the internal electronics are activated, the user puts the unit back on the table in the original orientation. Then the user must pair audio source 200 with Bluetooth module 181 using the screen and buttons on audio source 200, most commonly the settings tab on an iPhone or smart device.

Once connected, the unit will play audio from audio source 200. When music playback stops, or if the unit does not pair to an audio source, the unit will automatically power off after a predetermined delay to conserve power. If the user wishes to listen to more music, they should once again invert the unit and connect the audio source. If audio is playing and the user wishes to manually shut down the unit, they may invert the unit to activate tilt switch 183 to shut down amplifier electronics 180 and Bluetooth module 181.

Additional tilt switches can be added to increase functionality. For example, if the unit is tipped to one side, the volume level would increase. If the unit is tipped in the other direction, the volume level would decrease. Many additional functions exist and may be added at any time to any embodiment in this specification.

Tilt switch functionality is preferred for reasons of simplicity of design, and no additional machining of the vessel is necessary, such as drilling holes or cutting slots for a push button switch. But if a push button is deemed advantageous, drilling holes or cutting slots in the vessel are acceptable methods of giving the user access to a mechanical slide or push button switch. Alternatively, a push button switch could be mounted in vessel mouth 120, and the user would depress the button to activate the unit, or to turn the unit off. All of these on/off solutions, and further solutions not mentioned here, are viable methods of power management for all embodiments described in this specification. For the sake of simplicity, tilt switch 183 is not included in subsequent embodiments, but shall be assumed as present and part of amplifier electronics 180.

Amplifier electronics 180 may include LEDs which indicate the state of the device, include power on/off, pairing mode, or other indication. LEDs may also serve as entertainment and aesthetic enhancement, blinking to attract attention or illuminating in sync with the music. A low battery indicator or an equalizer may be included and visualized using LEDs on amplifier electronics 180.

Figure 9:
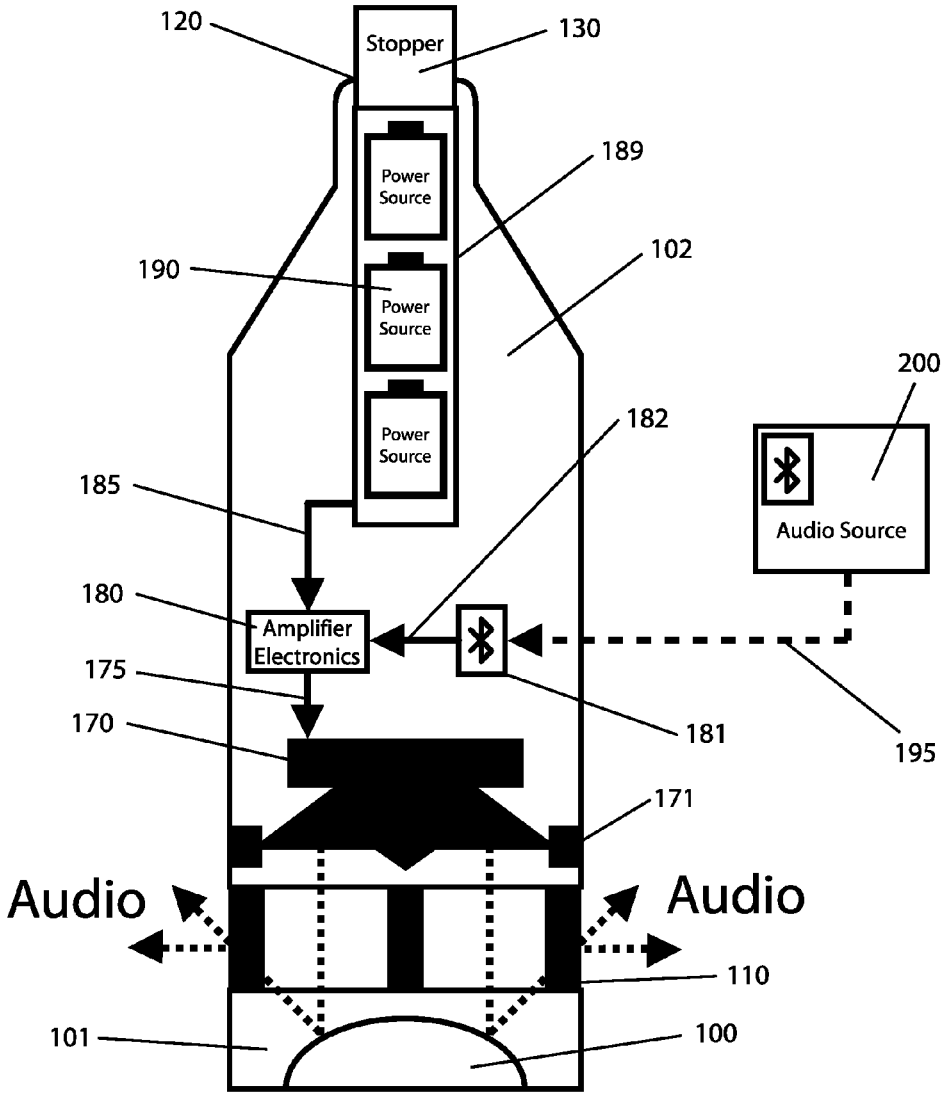
FIG. 9 shows an embodiment of the present invention with removable batteries.

FIG. 9 shows an embodiment of the present invention with removable batteries. This cylindrical aluminum beverage container has been cut into two pieces, vessel bottom 101 and vessel top 102, for installation of electronics. The current embodiment uses disposable batteries as power source 190. Stopper 130 seals the space behind speaker 170 and keeps the batteries inside the unit. Stopper 130 can be removed to take out old batteries and replace with new batteries. Stopper 130 may be removable by threads interfacing with the inner surface of vessel top 102, or may stay in place via friction or magnetic force until the user wishes to remove stopper 130. Electricity from power source 190 is transferred to amplifier electronics 180 via power cable 185.

Audio source 200 transmits audio signals via signal interface 195. In this embodiment, signal interface 195 is comprised of a wireless Bluetooth connection to Bluetooth module 181 inside of vessel top 102. In the current embodiment, Bluetooth module 181 is a stand-alone Bluetooth receiver module and does not require additional electronics to function, as opposed to the module described in FIG. 8 description, mounted on main PCB. The audio signal is received and then transmitted from Bluetooth module 181 to amplifier electronics 180 via Bluetooth cable 182. Bluetooth cable 182 may be a ribbon cable containing as many wires as are necessary for communication between Bluetooth module 181 and amplifier electronics 180. Bluetooth cable 182 may alternatively be traces or solder joints between Bluetooth module 181 and amplifier electronics 180.

Using power source 190 and signal from Bluetooth module 181, the amplifier can produce a signal to drive speaker 170, producing audio waves for user enjoyment. Audio waves from speaker 170 reflect off of punt 100 and pass between vessel bottom 101 and vessel top 102 through space created by spacer 110 radially to users all around the product.

Speaker 170 is mounted inside of vessel top 102 facing downward. In the case that speaker 170 has a smaller outer diameter than the inner diameter of vessel top 102, speaker seal 171 may be added to fill the space and seal the speaker cavity behind speaker 170. In the current embodiment, amplifier electronics 180 and Bluetooth module 181 may be secured to the upper side of speaker 170 using glue, tape, fasteners, or other adhesive method.

Power source 190 may require a power support structure 189 to fix batteries and facilitate electrical contact. Power support structure 189 may be useful for connecting power source 190 to power cable 185, and is most commonly comprised of plastic and metal. Alternatively, wood, cardboard, paper, or other material that provides structural integrity to support power source 190 is acceptable. Vessel bottom 101 is adhered to spacer 110, and spacer 110 adhered to vessel top 102 after installation of electronics using glue, tape, fasteners, or other appropriate method, so as to mechanically unify all parts of the present invention.

For alternate embodiments, spacer 110 may contain a hollow section such that wires transmitting audio signals or power may be discretely passed between vessel bottom 101 and vessel top 102. For example, in an alternate configuration wherein power source 190 is installed in vessel bottom 101 and other electronics including speaker 170 are installed in vessel top 102, a hollow channel in spacer 110 would be useful to conceal and protect power cable 185.

Figure 10:
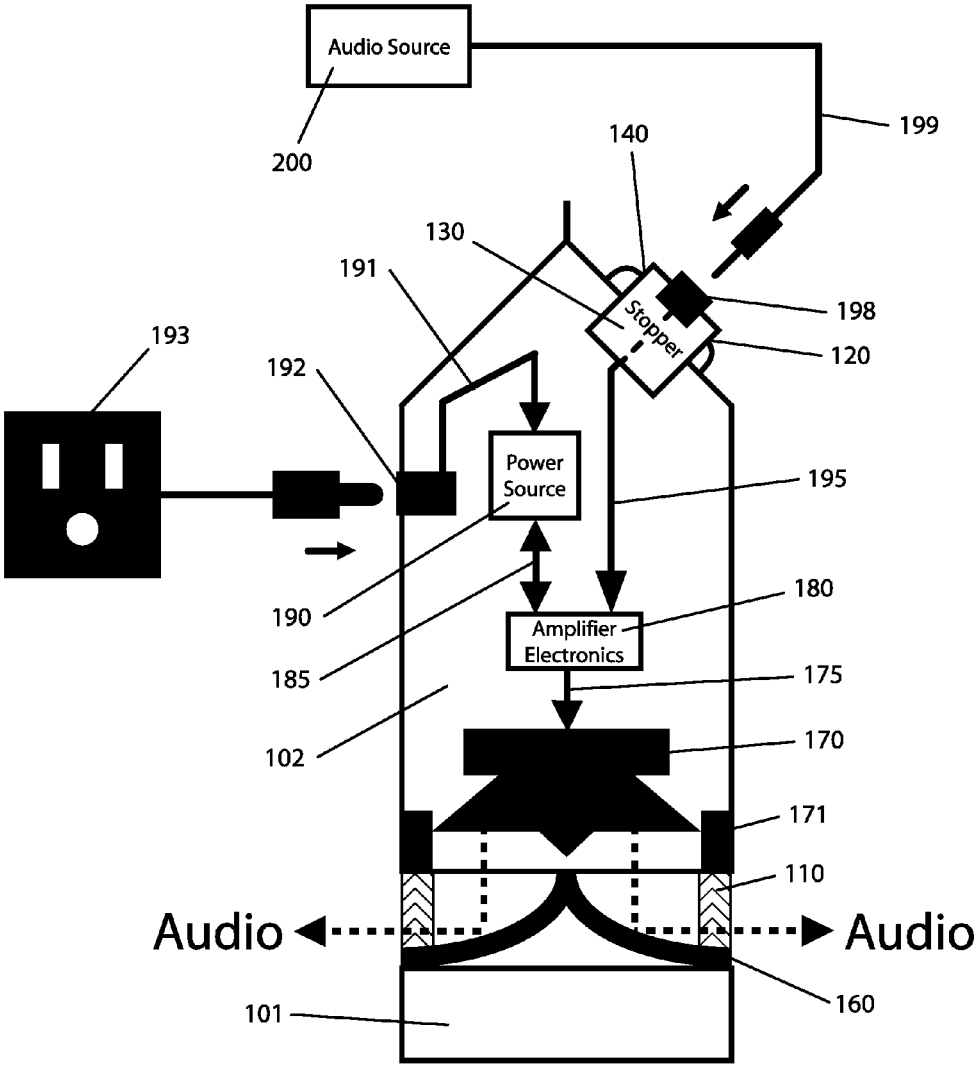
FIG. 10 shows an embodiment of the present invention with horn, and audio jack for devices without wireless capability.

FIG. 10 shows an embodiment of the present invention with horn, and audio jack for devices without wireless capability. The current embodiment shows a box shaped paper juice container cut into two pieces, vessel bottom 101 and vessel top 102, for insertion of electronics. This embodiment accommodates any device with a headphone jack or audio output, as opposed to previous embodiments requiring Bluetooth capabilities for audio transfer. Many devices still exist that do not offer Bluetooth or other wireless protocol, such as musical instruments, home entertainment equipment, and older MP3 players.

It should be noted that this solution which accommodates any music device with a headphone port may be combined with Bluetooth functionality from earlier embodiments to expand functionality and add optional wireless capabilities. Electric guitars and other musical instruments may be amplified using the current invention and a cord. In the current embodiment, audio source 200 is an iPod or MP3 player, which may or may not have Bluetooth capability.

Audio cord 199, a cable with male plug ends on each side, is used to connect audio source 200 to audio jack 198 for audio signal transfer. Audio cord 199 is commonly purchased "off the shelf", and consists of two insulated wires which conduct the audio signal. Audio jack 198 is commonly purchased "off the shelf", and is made of plastic and/or metal. Audio jack 198 connects to signal interface 195, which travels through sealed hole 140 in stopper 130 to carry audio signal to amplifier electronics 180. Stopper 130 is a cap or plug which seals the speaker cavity, and may be fixed using friction, glue, adhesives, or mating threads. When the user wishes to use the sound system, they connect their audio device to audio jack 198 using audio cord 199. Audio jack 198 may be configured in so as to activate amplifier electronics 180 when the plug of audio cord 199 is inserted. This may be desirable compared to a power switch or tilt switch. With this configuration, the sound system would automatically turn off when the user unplugs audio cord 199. The method of turning the sound system on and off shall not limit the scope of the present invention.

Amplifier electronics 180 receives power from power source 190, a rechargeable battery, via power cable 185. In the current embodiment, user does not have access to power source 190, therefore a method to recharge power source 190 in vessel top 102 is required. Charging source 193 may be a wall transformer, taking an AC input and creating a DC charging output. Charging source 193 may also include additional circuitry for controlled (smart) charging of power source 190. Charging source 193 plugs into power jack 192, and this electricity is sent to power source 190 via charging cable 191.

Amplified audio signal from amplifier electronics 180 is transferred to speaker 170 via speaker cable 175. Sound waves generated by speaker 170 reflect off of horn 160 and travel out radially to users around the device. Horn 160 is an alternative deflective surface to punt 100 from previous embodiments, and may be solid or hollow, with any shape that channels sound waves from the speaker cone users around the device. Horn 160 will most commonly be made of plastic, metal, or paper, but any material that will reflect sound waves and keep the horn shape is acceptable. For the present invention, horn 160 is not required, however may be used to improve sound system performance.

Speaker 170 is fixed to the inside surface of vessel top 102 via speaker seal 171, which may be comprised of rubber, plastic, metal, or any combination of materials that mechanically fix speaker 170 and create a sealed compartment behind speaker 170. Horn 160 may be implemented in any other embodiment to aid in directing sound out radially from the repurposed housing.

Spacer 110 separates vessel bottom 101 from vessel top 102 for audio to pass from speaker 170 to users. Spacer 110 and horn 160 may be combined into one piece that both couples vessel bottom 101 to vessel top 102, and channels sound from the speaker. Additionally, spacer 110, horn 160, and/or speaker seal 171 may be combined into one piece that serves the same functions as the individual components. This is desirable to reduce part count and simplify design.

Figure 11:
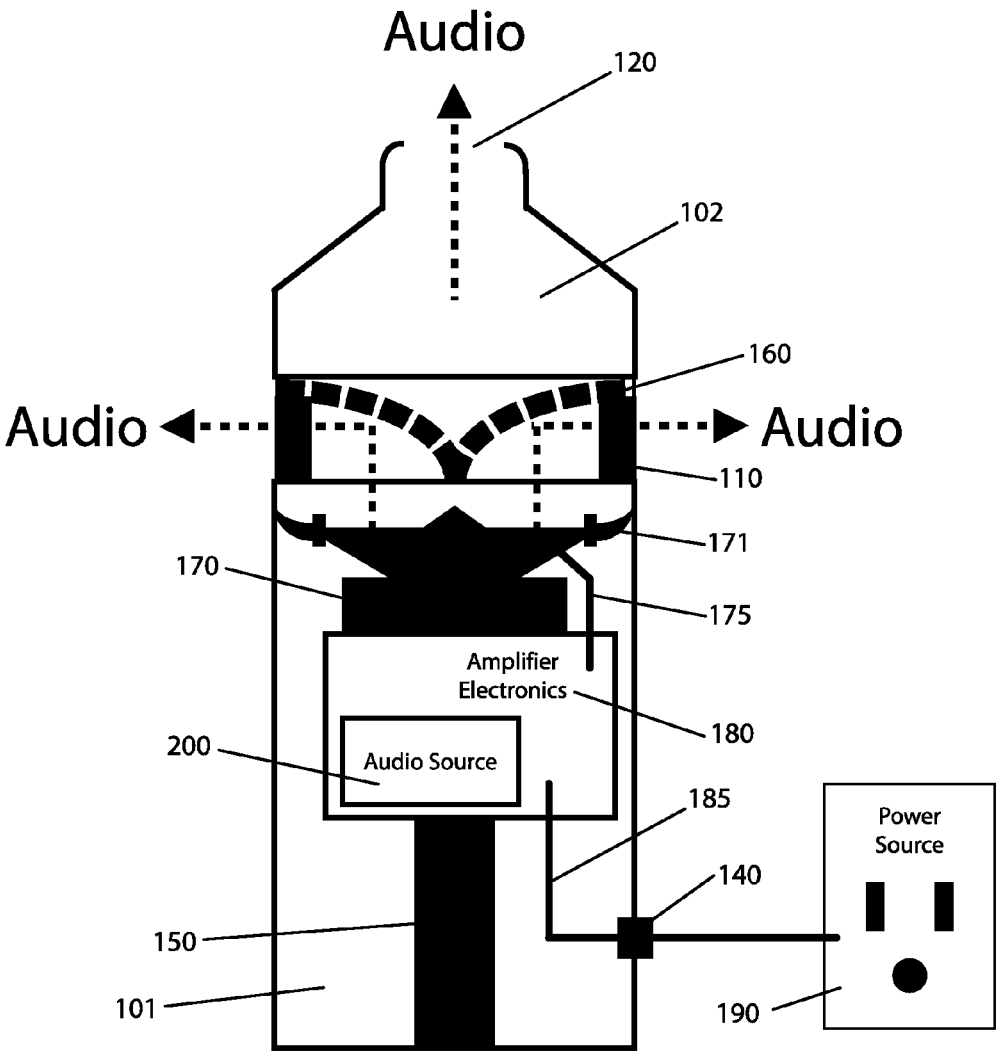
FIG. 11 shows an embodiment of the present invention with perforated horn and internal audio source.

FIG. 11 shows an embodiment of the present invention with perforated horn. The vessel is a ceramic bottle with cylindrical shape, cut into two pieces: vessel bottom 101 and vessel top 102. Previous embodiments depicted electronics in vessel top 102, but the current embodiment shows electronics in vessel bottom 101. The location of electronics shall not limit the scope of the present invention.

This embodiment does not include power source 190 inside of vessel bottom 101 or vessel top 102, but rather utilizes an external wall transformer to supply electricity to amplifier electronics 180 via power cable 185. Power cable 185 travels through vessel bottom 101 wall through sealed hole 140. A wall transformer is ideal for applications such as home theater speakers, because high performance audio requires large amount of current that cannot be supplied by a battery.

Wall transformed may have a cord which passes through sealed hole 140 and is soldered directly to amplifier electronics 180 circuit board. Users cannot lose wall transformer because it is attached to speaker unit. Alternatively, power source 190 may include a cord with plug for easy separation of power source 190 from speaker unit during transport. In this case, power jack 192 from the previous embodiment would stand in place of sealed hole 140, and would accept plug from power source 190.

In this embodiment, audio source 200 is built into the electronics, containing pre-recorded content stored in memory. Audio source 200 could also represent a radio receiver. Alternatively, the current embodiment could be a Bluetooth enabled speaker device like the previous embodiments, which accepts a signal from a home theater system, and transmits the audio signal to other Bluetooth speakers in the vicinity. This allows for surround sound capabilities often utilized in home theater setups.

Audio source 200 sends audio signals to amplifier electronics 180 via traces on the circuit board for signal amplification. Amplifier electronics 180 amplifies audio using power from power source 190 to create a signal for speaker 170. This audio signal is transferred from amplifier electronics 180 to speaker 170 via speaker cable 175.

Audio waves generated by speaker 170 travel upward from speaker cone. Some of the sound waves deflect off of horn 160, but because of perforations in horn 160, the remaining waves pass through horn 160 out of the mouth 120. All previous embodiments employed a stopper in mouth 120 to force audio out radially from the speaker unit, but depending on the environment and listener position relative to the speaker unit, the stopper may be eliminated to change sound characteristics.

Speaker 170 is attached to speaker seal 171 via glue, friction, or other adhesive method. Speaker seal 171 in the current embodiment is a thin flexible rubber material which conforms to the inside surface of vessel bottom 101 for proper seal. Because of the flexible nature of speaker seal 171, it cannot be used for mechanically fixing speaker 170 and electronics within vessel bottom 101. Therefore, riser 150 is adhered to the bottom interior surface of vessel bottom using tape, glue, or fasteners.

Amplifier electronics 180 are attached to riser 150, and speaker 170 is attached to amplifier electronics 180, therefore all components fixed via riser 150. Riser 150 may be implemented in previous embodiments for additional mechanical stability. Riser 150 may be solid, or hollow to save weight, and may be any material which provides the requisite mechanical stability, including wood, plastic, metal, ceramic, or cardboard.

Vessel bottom 101 with internal electronics is attached to spacer 110. Spacer 110 is attached to horn 160, and horn 160 is attached to vessel top 102. Therefore, all parts of the present invention are fixed. Appropriate means of attachment include glue, tape, fasteners, friction, or any combination of those items.

Figure 12:
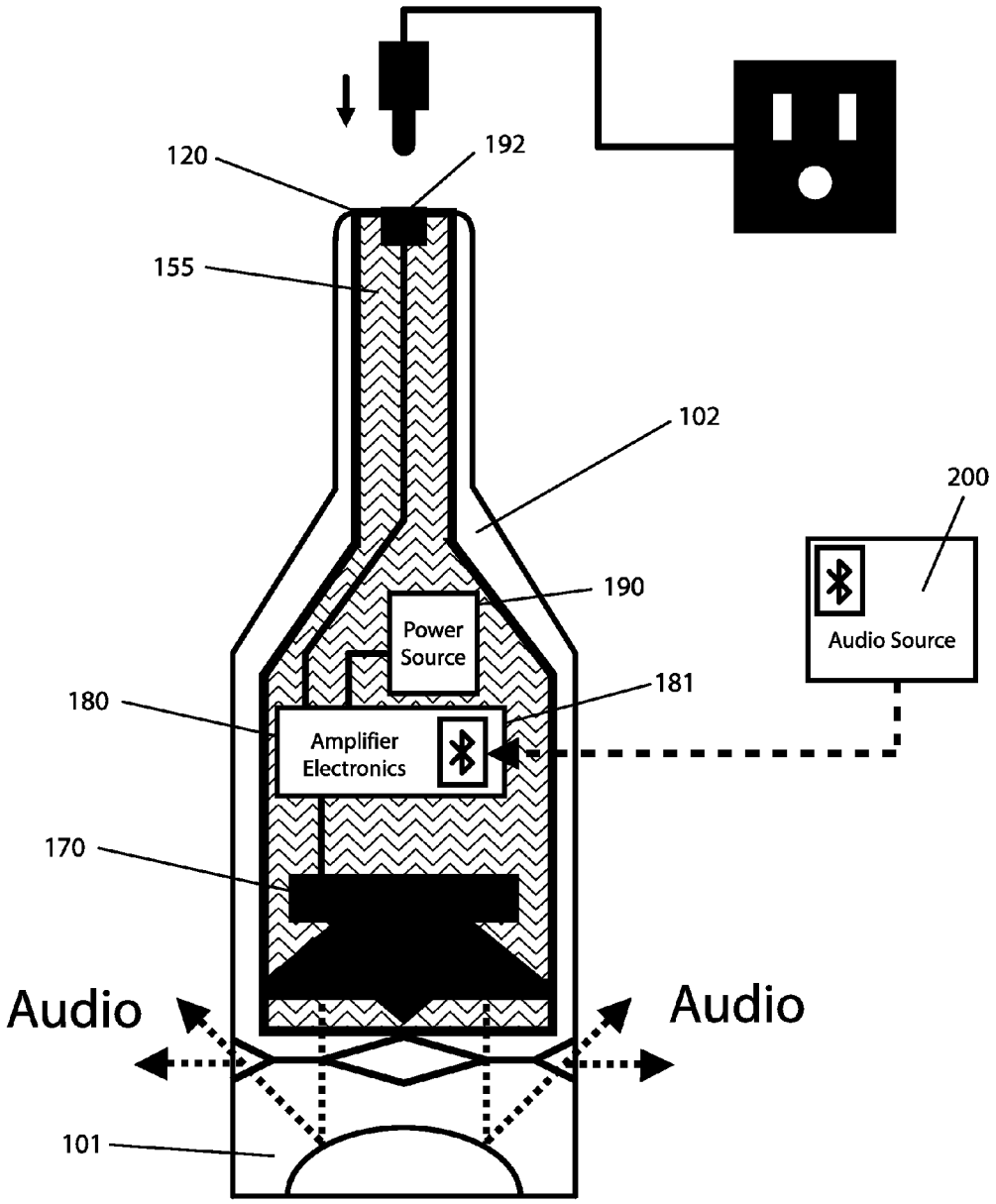
FIG. 12 shows an embodiment of the present invention featuring a universal support structure to overcome repurposed material dimensional variability.

FIG. 12 shows an embodiment of the present invention featuring a universal support structure. This embodiment is similar to FIG. 8, so for the sake of clarity and simplicity, elements not marked or discussed in FIG. 12 should be assumed as unchanged from FIG. 8.

This embodiment addresses the problem of vessel body diameter and cylindricity. There are many sizes and shapes of repurposed materials. Vessels will commonly be comprised of glass, which is not formed to a high tolerance. The vessel body diameter may deviate significantly on the same manufacturing line. Additionally, the cylindricity of the bottles may vary. In FIG. 8, speaker 170 was sealed in vessel top 102 via speaker seal 171. However, differing sizes and degrees of cylindricity make sealing speaker 170 very difficult, and may require a custom seal for each vessel.

The feature with the least amount of variation in wine bottles and other similar vessels is the inner diameter of vessel mouth 120. Therefore, this embodiment takes advantage of this insight, creating a solution which is solely fixed to vessel mouth 120 and is therefore not dependent on the size, shape or cylindricity of the main vessel body.

To install components required for audio amplification, the vessel is cut into two pieces: vessel bottom 101 and vessel top 102. In this embodiment, universal support structure 155 contains speaker 170, amplifier electronics 180, Bluetooth module 181, power source 190, power jack 192, and all interconnects between those items. Universal support structure 155 shall be made of any rigid material so as to provide mechanical stability, holding the aforementioned components in place. Glue, adhesives, fasteners, and friction are acceptable means of holding components in place. Additionally, universal support structure 155 creates a sealed chamber behind speaker 170 for optimal sound performance.

The size and shape of universal support structure 155 may be any that houses the necessary electronic components, while still fitting inside of vessel top 102. The diameter and length of the neck of universal support structure 155 shall be determined by the vessel for which the universal support structure 155 is made. In this depiction, universal support structure 155 has a neck diameter slightly smaller than the inside diameter of vessel mouth 120 to allow for glue to fix the two items together.

The electronic components are fixed within universal support structure 155, with speaker 170 at the bottom end, then amplifier electronics 180, then power source 190, and lastly charge jack 192 at the top end. Amplifier electronics 180 may be mounted next to or above power source 190. The location of these items shall not limit the scope of the current invention. Universal support structure 155 is not required to contain all of the items mentioned above. It is minimally required to contain speaker 170. Conversely, universal support structure 155 may contain items commonly used in sound systems not mentioned explicitly in this specification, such as a radio tuner or LCD screen.

In this embodiment, universal support structure 155 is a hollow plastic shell with internal features such as grooves and pins to fix components in place. These internal features of universal support structure 155 will not only mechanically fix components, but will also create a sealed chamber so as to maximize audio output from speaker 170. This seal may be created using glue, adhesives, fasteners, o-rings or friction. In this embodiment, universal support structure 155 is made of clear plastic so as not to be noticed by the user, as if the electronic components are floating in the vessel. Alternatively, universal support structure 155 may be a semi-transparent or opaque plastic, which can be illuminated by LEDs included in amplifier electronics 180. This provides the user with an aesthetically pleasing light show, and may alert them to the state of the device.

Universal support structure 155 may be comprised of two halves so as to ease the installation of the electronic components, to be fixed together after installation is complete. However, there is no limit to the number of pieces that may comprise universal support structure 155. Universal support structure 155 contains all components necessary for audio playback, and can be mass produced. Universal support structure 155 will withstand shipping because of the rigidity of the material. Shipping the electronics without universal support structure 155, where components are connected with wires but not mechanically fixed in reference to one another, could easily result in damage during transportation to the site where they would be installed in the repurposed vessel.

Universal support structure 155 is fixed in vessel top 102 via vessel mouth 120 and the neck section of vessel top 102 below vessel mouth 120. During assembly, universal support structure 155 is inserted into vessel top 102 until the top of universal support structure 155 is flush with vessel mouth 120. Alternatively, the top of universal support structure 155 can be manufactured with an extra long neck. The neck can be trimmed to be flush with vessel mouth 120 during the time of assembly, which accounts for varying heights of repurposed housings. Then glue or other fixative is poured in the space between universal support structure 155 and vessel mouth 120. Alternatively, universal support structure 155 may be fixed using friction or rubber gasket. In all cases, universal support structure 155 shall have a smaller neck diameter than the inner diameter of vessel mouth 120. Universal support structure 155 may also be mechanically fixed to vessel top 102 via fasteners or adhesive tape. After installation of universal support structure 155 in vessel top 102, the assembly is attached to vessel bottom 101 using glue or other appropriate adhesive.

Figure 13:
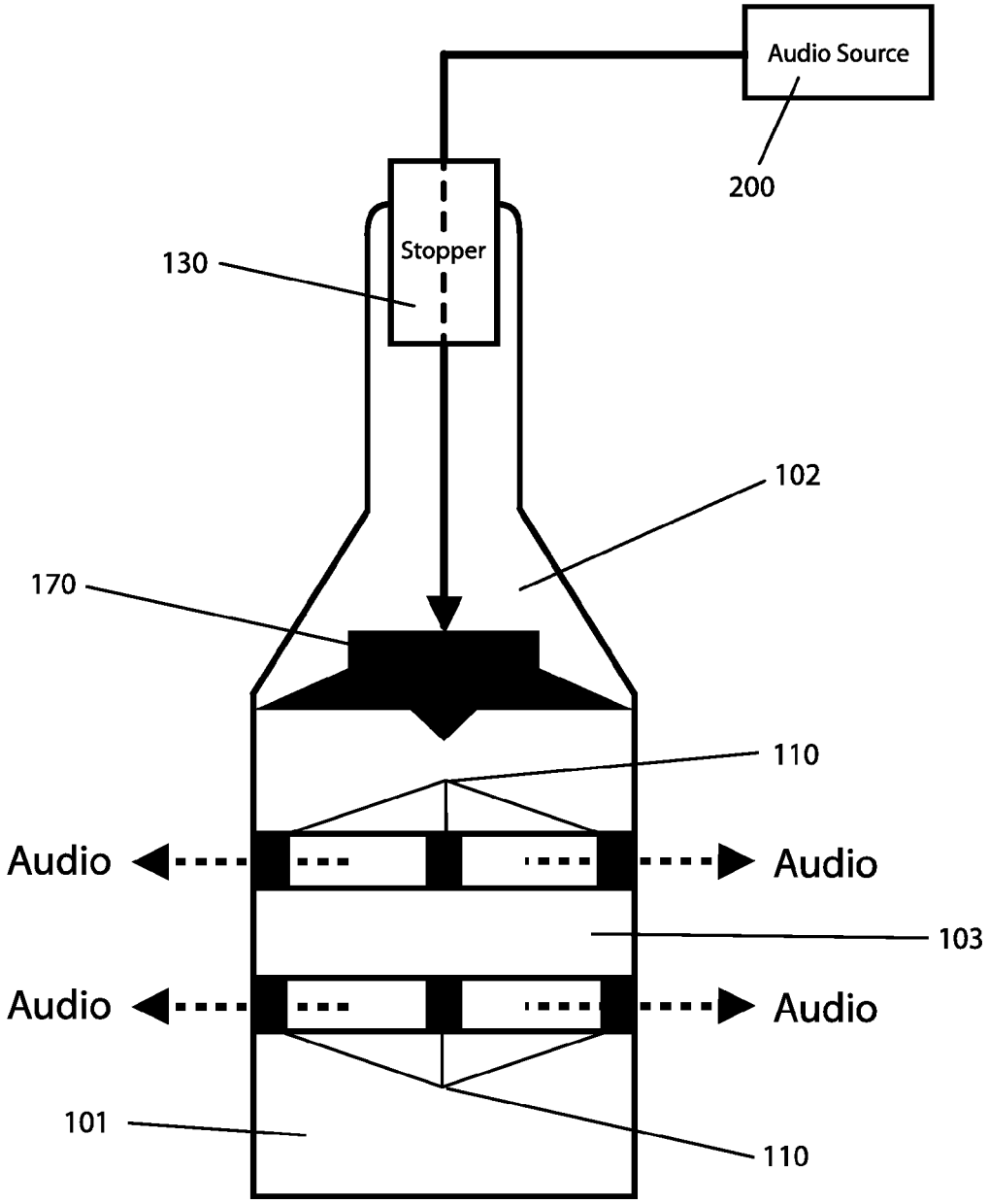
FIG. 13 shows an alternate embodiment of the present invention featuring multiple ring openings.

FIG. 13 shows an alternate embodiment of the present invention featuring multiple ring openings. This embodiment is similar to FIG. 7, so for the sake simplicity, elements not marked or discussed in FIG. 13 should be assumed as unchanged from FIG. 7.

In this embodiment, vessel is a glass bottle with cylindrical body. However, the material and the shape of the body shall not limit the scope of this embodiment. To install speaker 170, vessel is cut open. Two cuts create vessel bottom 101, vessel top 102, and vessel mid section 103. Vessel top 102 contains speaker 170 with input from external audio source.

After insertion of speaker 170, the pieces of vessel are reassembled in their original orientation with multiple instances of spacer 110 in between. Vessel bottom 101 is attached to the lower instance of spacer 110, which is attached to vessel mid section 103. The upper side of vessel mid section 103 is attached to the upper instance of spacer 110, which is attached to vessel top 102. Glue, fasteners, tape, friction or any combination of those items are acceptable solutions for attaching vessels to spacers.

Having multiple ring openings may be advantageous when compared to one sound ring shown in FIG. 7 because it creates more space through which audio may pass. The size and positioning of these rings of space may be altered to tune for desired frequency response. Alternatively, the invention may forgo use of spacers and instead remove sections of vessel parts as in FIG. 6. This embodiment may also include integrated electronics. The number of ring openings shall not limit the scope of this invention. The size and positioning of the ring openings shall not limit the scope of the present invention. Additionally, the ring opening is not required to be open 360 degrees around the diameter of the vessel. For example, the ring openings may have two 90 degree sections on opposing sides to direct music in two opposing directions.

Figure 14:
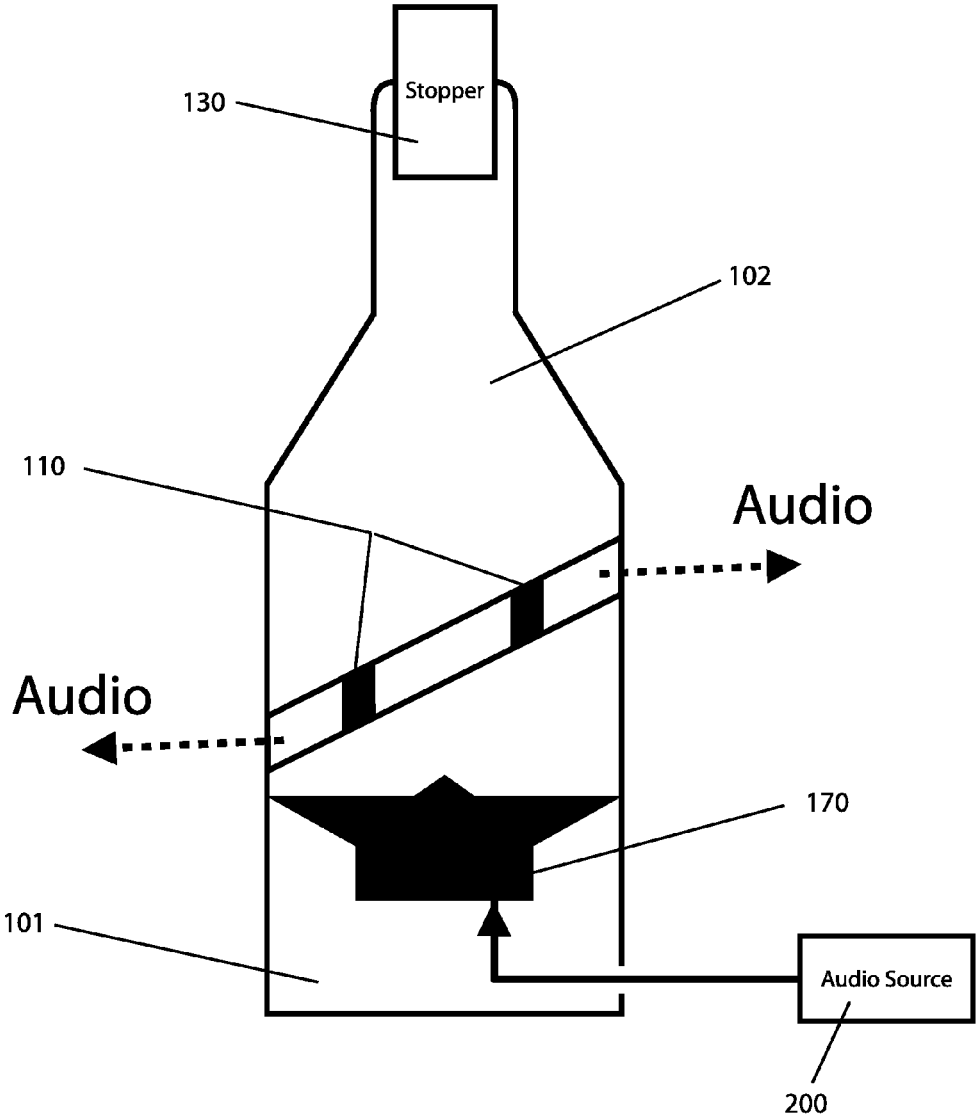
FIG. 14 shows an alternate embodiment of the present invention featuring a slanted ring opening.

FIG. 14 shows an alternate embodiment of the present invention featuring a slanted ring opening. This embodiment is similar to FIG. 7, so for the sake of simplicity, elements not marked or discussed in FIG. 14 should be assumed as unchanged from FIG. 7.

To install speaker 170, vessel is cut into two pieces using an angled cut. Speaker 170 is installed in vessel bottom 101. Then vessel bottom 101 is attached to vessel top 102 via spacer 110. In previous embodiments, the ring opening was fashioned in a horizontal orientation. However, this embodiment demonstrates that the angle of the ring opening shall not limit the scope of this invention. This embodiment may be combined with the previous embodiment, wherein multiple ring openings are fashioned using angled cuts. Angled ring openings may provide desirable acoustic and aesthetic properties when compared to horizontal ring openings.

Figure 15:
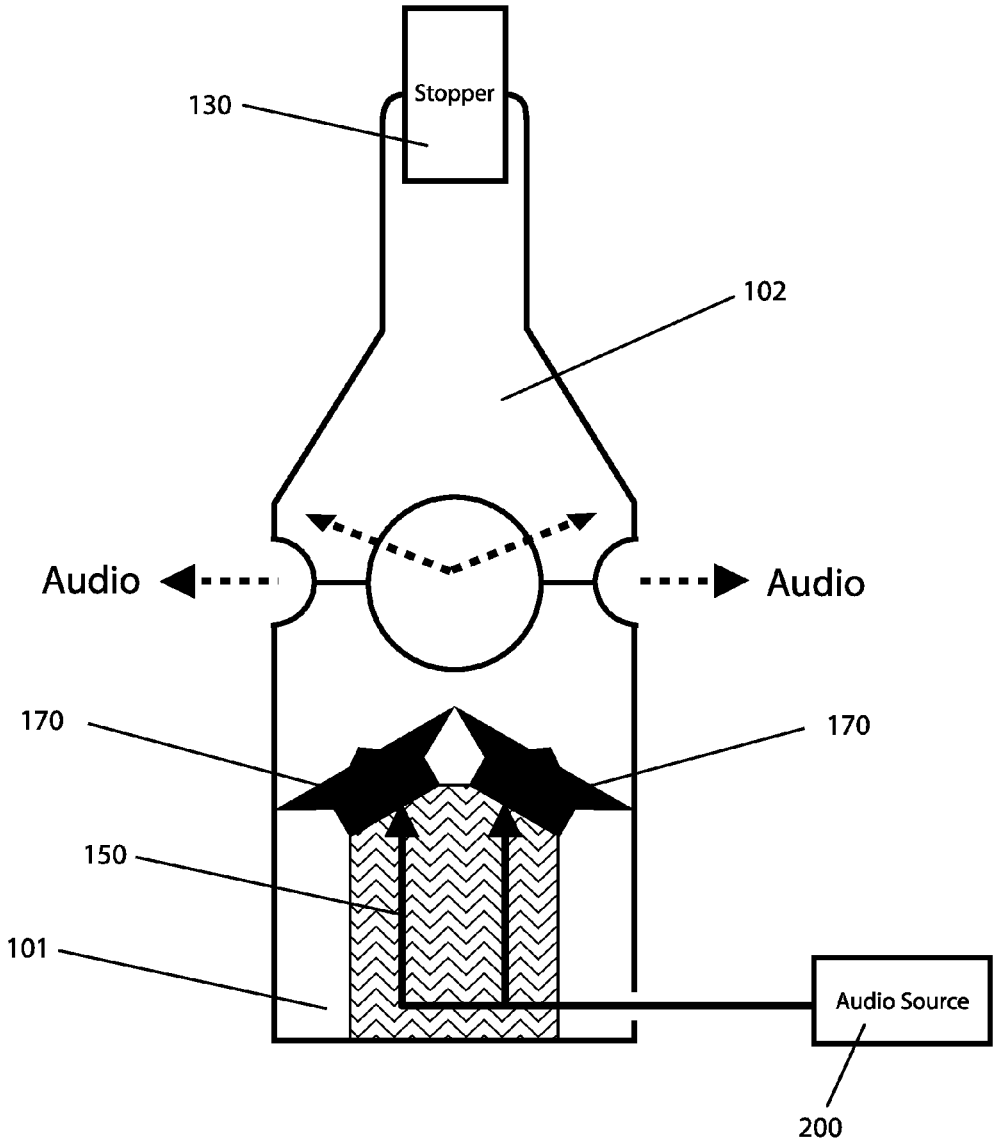
FIG. 15 shows an alternate embodiment of the present invention with multiple angled speakers.

FIG. 15 shows an alternate embodiment of the present invention with multiple angled speakers. Multiple speakers may be used, as opposed to one speaker, to achieve different sound properties. This embodiment is similar to FIG. 6, so for the sake of clarity and simplicity, elements not marked or discussed in FIG. 15 should be assumed as unchanged from FIG. 6.

The vessel is cut into two portions: vessel bottom 101 and vessel top 102. In this embodiment, vessel bottom 101 contains two instances of speaker 170. These instances of speaker 170 are mechanically secured using riser 150. Vessel bottom 101 is reattached to vessel top 102 after installation of two instances of speaker 170. Two speakers generate audio waves which pass out through the cuts made in vessel bottom 101 and vessel top 102. Using multiple smaller speakers as opposed to one larger speaker may be desirable for acoustic reasons and manufacturing reasons.

Additionally, the two instances of speaker 170 are mounted such as their central axis are not vertically oriented. This may allow for multiple larger diameter speakers to fit together in a small space when compared to mounting speakers with vertical axis orientation. The speaker or speakers may be mounted on an angle to accommodate oddly shaped electronic components which reside behind the speaker. The angle of the speaker axis relative to the repurposed material shall not limit the scope of this invention. The invention may contain one speakers with a tilted axis. Or the invention may contain two speakers with parallel axis. Alternatively, one speaker may be contained in the top portion facing downward, and another speaker may be contained in the lower portion facing upward with a double sided horn between them. The number of speakers shall not limit the scope of this invention, nor the orientation of those speakers.

Figure 16:
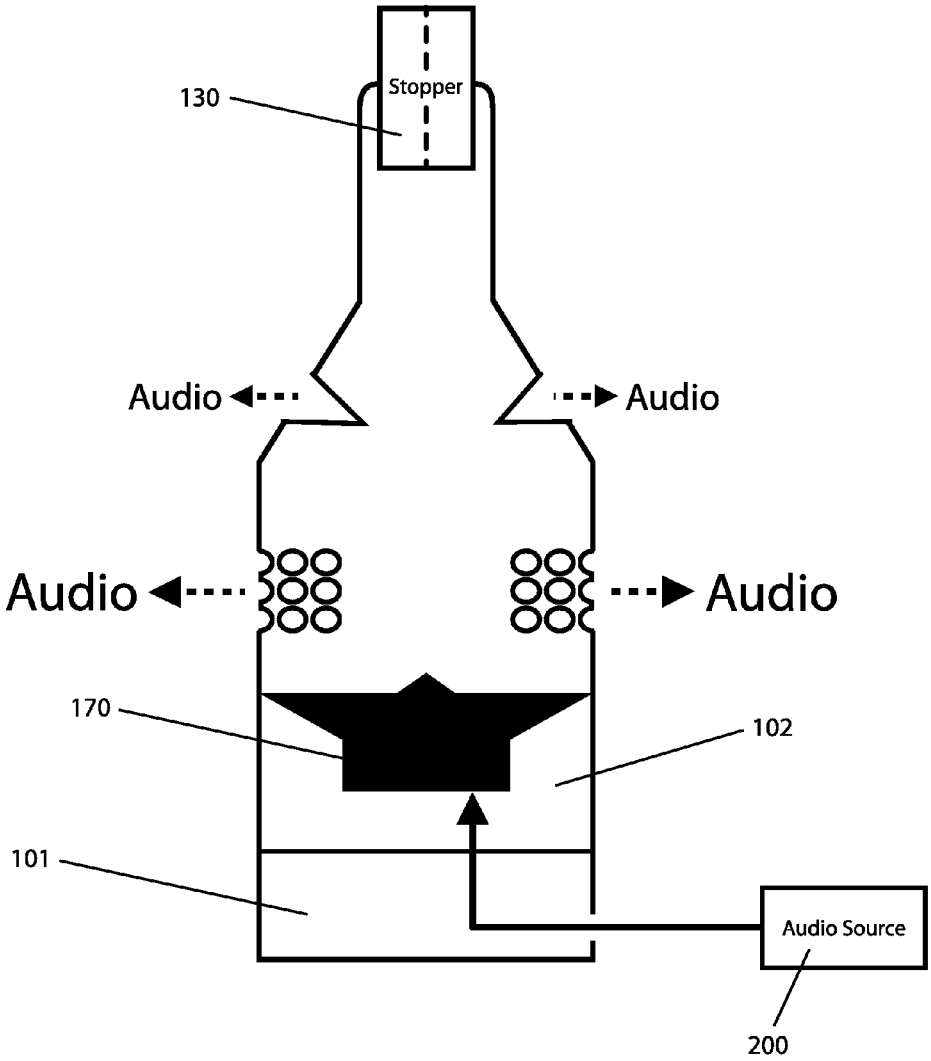
FIG. 16 shows an alternate embodiment of the present invention with an array of holes for openings.

FIG. 16 shows an alternate embodiment of the present invention with an array of holes for openings. This embodiment is similar to FIG. 6, so for the sake of clarity and simplicity, elements not marked or discussed in FIG. 16 should be assumed as unchanged from FIG. 6.

The vessel is cut into two portions: vessel bottom 101 and vessel top 102. Speaker 170 is installed in vessel top 102. Alternatively, speaker 170 may be fixed to vessel bottom 101. In this embodiment, either solution is acceptable. Holes have been machined in vessel top 102 in an array pattern. This embodiment has two hole arrays on opposing sides of the vessel through which audio waves may pass. Therefore, sound travels outward in two opposite directions. The hole array could be expanded to wrap around the entire vessel body if 360 degree audio broadcasting is desired. Additionally, two small angled cuts have been made toward the top of vessel top 102. These cuts create more space through which audio may pass. The shape and positioning of the cuts can be altered to produce desired audio properties.

The shape, size, and positioning of openings shall not limit the scope of this invention. The number of openings shall not limit the scope of this invention. Full 360 degree sound output may be preferred, but is by no means required, for the present invention.

All previous embodiments utilized openings formed between vessel bottom 101 and vessel top 102. These openings were formed by means of a spacer between vessel bottom 101 and vessel top 102, or by means of removing material from the vessel bottom 101 and/or vessel top 102. However, this figure demonstrates that the openings through which audio passes are not required to be implemented between vessel bottom 101 and vessel top 102. The openings may be located in any location on the body such that sound radiates out to users around the device.

It is understood that the above-described embodiments and examples are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Additionally, although the figures illustrate particular presentations of information, it is understood that the varieties of such that satisfy the limitations of the claims are plethoric.

It is also envisioned that embodiments of the invention may incorporate technologies not yet in existence and may operate in manners not yet contemplated.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as series forth in the claims. Further, it is contemplated that an embodiment may be limited to consist of or to consist essentially of one or more of the features, functions, structures, methods described herein.

The invention claimed is:

1. A sound system made from a vessel of repurposed material comprising:

the vessel of repurposed material cut such that the vessel of repurposed material is separated into at least two portions thereby creating a first opening, and additional material is removed from at least one of the portions along a surface created by the cut, thereby creating a second opening allowing audio waves to pass out of the vessel of repurposed material when the portions are reassembled;

a speaker assembly placed inside one of the portions through the first opening created by cutting the repurposed vessel into at least two portions, and, an audio source connected to the speaker assembly.

2. The apparatus of claim 1, wherein the audio source is connected to the speaker assembly using a cable.

3. The apparatus of claim 1, wherein the audio source is connected to the speaker assembly using a wireless technology.

4. A sound system made from a vessel of repurposed material comprising:

the vessel of repurposed material cut such that the vessel of repurposed material is separated into at least two portions thereby creating a first opening, and a spacer is placed between at least two of the portions, preventing at least two of the portions from touching, thereby creating a second opening allowing audio waves to pass out of the vessel of repurposed material when the portions are reassembled;

a speaker assembly placed inside one of the portions through the first opening created by cutting the repurposed vessel into at least two portions, and, an audio source connected to the speaker assembly.

5. The apparatus of claim 4, wherein the audio source is connected to the speaker assembly using a cable.

6. The apparatus of claim 4, wherein the audio source is connected to the speaker assembly using a wireless technology.

* * * * *